United States Patent [19]

Kenyeres et al.

[11] Patent Number: 4,840,751

[45] Date of Patent: Jun. 20, 1989

[54] PROCESS FOR CONTACTING GASES WITH LIQUIDS

[75] Inventors: István Kenyeres; Lehel Koch, both of Budapest, Hungary

[73] Assignee: Innofinance Általános Innovácios Pénzintézet, Budapest, Hungary

[21] Appl. No.: 123,228

[22] Filed: Nov. 20, 1987

[30] Foreign Application Priority Data

Nov. 28, 1986 [HU] Hungary ..... 4943/86

[51] Int. Cl.[4] ..... B01F 3/04

[52] U.S. Cl. ..... 261/36.1; 261/DIG. 75; 261/119.1

[58] Field of Search ..... 261/DIG. 75, 36.1, 119.1

[56] References Cited

U.S. PATENT DOCUMENTS

| | | | |
|---|---|---|---|
| 1,059,899 | 4/1913 | Morison | 261/36.1 |
| 3,826,742 | 7/1974 | Kirk et al. | 261/119.1 |
| 4,085,171 | 4/1978 | Baker et al. | 261/119.1 |
| 4,138,330 | 2/1979 | Garrett | 261/119.1 |
| 4,224,158 | 9/1980 | Molvar | 261/DIG. 75 |
| 4,264,039 | 4/1981 | Moreland | 261/DIG. 75 |
| 4,280,982 | 7/1981 | Shindome et al. | 422/185 |
| 4,308,138 | 12/1981 | Woltman | 261/DIG. 75 |
| 4,726,917 | 2/1988 | Abe | 261/DIG. 75 |
| 4,735,750 | 4/1988 | Damann | 261/DIG. 75 |

FOREIGN PATENT DOCUMENTS

| | | | |
|---|---|---|---|
| 127999 | 12/1984 | European Pat. Off. . | |
| 2059415 | 6/1971 | Fed. Rep. of Germany | 261/DIG. 75 |
| 2415940 | 10/1974 | Fed. Rep. of Germany | 261/36.1 |
| 2752391 | 3/1985 | Fed. Rep. of Germany . | |
| 2241500 | 3/1975 | France | 261/DIG. 75 |
| 48942 | 1/1965 | Poland | 261/DIG. 75 |
| 95365 | 4/1921 | Switzerland | 261/DIG. 75 |
| 398503 | 3/1966 | Switzerland . | |
| 308254 | 6/1930 | United Kingdom | 261/DIG. 75 |
| 1239727 | 7/1971 | United Kingdom | 261/DIG. 75 |
| 1304208 | 1/1973 | United Kingdom . | |
| 1563995 | 4/1980 | United Kingdom . | |
| 1584002 | 2/1981 | United Kingdom . | |
| 2111844 | 7/1983 | United Kingdom . | |

OTHER PUBLICATIONS

Chem. Eng. Commun. 15, 367/1982.
CHem. Eng. Sci. 1161/1981.
Linek et al., Chem. Eng. Sci. 36, 1747, (1981).

*Primary Examiner*—Tim Miles
*Attorney, Agent, or Firm*—Schweitzer & Cornman

[57] ABSTRACT

The invention relates to a process for contacting a gas with a liquid, wherein the liquid to be contacted is led in the form of a central liquid jet leaving a nozzle through the space containing the gas to be contacted into the liquid to be contacted. In accordance with the process of the invention, a part of the gas and/or the liquid to be contacted, or the total amount of the gas, or a part of the liquid and the total amount of the gas are led onto the surface of the central liquid jet in the form of gas or liquid jets directed to the surface of the central liquid jet.

4 Claims, 2 Drawing Sheets

PROCESS FOR CONTACTING GASES WITH LIQUIDS

FIELD OF THE INVENTION

This invention relates to a process for contacting gases with liquids, wherein the liquid to be contacted is issued from a nozzle in the form of a liquid jet and is led through the space containing the gas to be contacted into the bulk of the liquid to be contacted.

BACKGROUND OF THE INVENTION

Gas-liquid contacting is considered to be one of the most important unit operations in several sectors of industry. Such contacting may substantially determine the feasibility of the whole technology as well as the technical parameters of the products.

The efficiency of gas-liquid contacting has a decisive role in most of the aerobic processes in the fermentation industry, in the aerobic biological purification of sewage as well as in a number of chemical processes.

The known gas-liquid contacting systems can be grouped according to the method of energy transfer as follows:

pneumatic systems (bubble columns, air-lift loop reactors etc.)

mechanical systems (surface aerators with horizontal or vertical shaft, self-sucking stirrers)

combination of the above systems (gas-sparged stirred reactors)

hydraulic systems.

As far as the efficiency of the energy transfer is concerned, hydraulic systems proved to be the most advantageous techniques in gas-liquid contacting, manifested in the increasing spread of this method in the last years.

A common characteristic of the hydraulic systems is that the gas-liquid contacting is carried out by liquid jets of various forms produced by a pump and some kind of a nozzle.

Depending on the character of the liquid jet, these processes can be distinguished as follows:

processes using disrupted liquid jets (spraying towers, Venturi scrubbers)

processes using two-phase liquid jets (injectors and ejectors)

processes using homogeneous, coherent, plunging liquid jets.

Within the hydraulic systems these latter type of processes can provide both the most advantageous energy efficiency and the highest possible specific mass transfer rate (intensity of gas-liquid contacting) as well as the lowest specific investment costs.

A common feature of the plunging liquid jet processes is that the homogeneous, coherent liquid jet, issued from the nozzle above the surface of the liquid body, travels through the gas space above the liquid surface and enters the bulk of the liquid while entraining a large amount of the gas from the gas space above the liquid surface. The entrainment of the gas is carried out in such a way that—due to the surface roughness of the liquid jet—a gas boundary layer is being developed on the surface of the jet while it passes through the gas space and, entering the liquid body together with the liquid jet itself, it is broken up into fine bubbles under the effect of shear forces between the jet and the liquid body.

The efficiency of these processes is simultaneously determined by the surface roughness and the coherency of the liquid jet in the following way:

the greater is the surface roughness of the liquid jet, the higher can be the gas entrainment rate, thus the quantity of the gas to be dissolved will be increased the more coherent the liquid jet is, the finer gas dispersion and the deeper bubble penetration depth can be achieved (the longer will be the residence time of the bubbles), thus the intensity of contacting will be increased.

Generally, it can be stated that none of the known plunging jet gas-liquid contactors can satisfy simultaneously and advantageously the above-mentioned two requirements, i.e. the known techniques can increase the surface roughness of the jet only by simultaneously diminishing the coherency of the liquid jet or vice versa.

To increase the surface roughness of the liquid jet one or the combination of the following methods is used without exception by all of the known processes (e.g. Chem. Eng. Sci. 36, 1161 /1981/; Chem. Eng. Commun. 15, 367 /1982/; published Hungarian patent application No. 3901/81):

using a nozzle having a shape differing from the hydraulic optimum increasing the velocity of the liquid jet increasing the level of turbulence of the liquid jet increasing the free length of the liquid jet.

The common disadvantage of these methods is that, on the one hand, they cause significant hydraulic losses, hence decreasing the energy efficiency of contacting, and, on the other hand, all of these methods result in decreasing the coherency of the jet, hence decreasing the intensity of contacting.

DESCRIPTION OF THE INVENTION

The aim of the invention is to eliminate the above disadvantages by making the simultaneous but independent optimization of those two parameters possible which are responsible for the efficiency of the process, namely the surface roughness and the coherency of the jet, in order to satisfy the specific requirements of any gas-liquid contacting operation.

The invention is based on the recognition that the surface of the liquid jet can directly be roughened without considerably decreasing the coherency of the liquid jet if the gas to be contacted or a part of the gas and/or the liquid is blown onto the surface of the jet.

Thus, the invention relates to a process for contacting gases with liquids, wherein the liquid to be contacted is led in the form of a central liquid jet leaving a nozzle through the space containing the gas to be contacted into the liquid to be contacted.

In accordance with the process of the invention, a part of the gas and/or the liquid to be contacted, or the total amount of the gas, or a part of the liquid and the total amount of the gas are led onto the surface of the central liquid jet in the form of gas or liquid jets directed to the surface of the central liquid jet.

Concerning the roughening of the surface of the liquid jet, essentially identical effect can be achieved by blowing either the gas or the liquid onto the surface of the jet. Generally, the use of a gas jet is preferable when the gas-liquid contacting is carried out in a closed reactor into which the gas to be contacted should be introduced under pressure.

The roughening carried out simultaneously by gas and liquid jets is in general preferably when the amount or the pressure of the gas to be contacted is not sufficient to provide the necessary surface roughness.

The roughening by a liquid jet is in general preferable when the contacting is performed in an open system and the gas to be contacted is the atmospheric air itself, like e.g. in case of biological sewage treatment, aeration of surface waters or fish-ponds.

The gas or the liquid jets used for roughening are conducted from orifices, preferably having circular cross-sections and uniformly arranged around the coherent liquid jet, or from a slot encircling the liquid jet.

As far as the result of the roughening is concerned, the gas and/or the liquid jets can be conducted onto the surface of the coherent liquid jet anywhere between the nozzle exit and the plunge point. It is preferable, however, to carry out the roughening as close to the nozzle exit as possible, since in this way the free length of the liquid jet can substantially be decreased.

The gas or the liquid jet used for roughening may be directed either downward or upward to the flow of the central jet. To achieve the appropriate roughening it is advisable to maintain an angle of at least 5° between these gas and/or liquid jets and the central jet.

The main advantages of the process according to the invention as compared to the known solutions can be summarized as follows:

(a) The energy efficiency of contacting is substantially increased, by about 30 to 60%.

(b) The range of application can significantly be extended.

(c) The reliability of design and scale-up is improved.

(d) The range of the control parameters is remarkably extended, even within the same process.

(e) The free length of the liquid jet can significantly be decreased, resulting in better utilization of the reactor volume.

DESCRIPTION OF THE DRAWING

The invention is described with reference to the attached drawing in which.

DESCRIPTION OF PREFERRED EMBODIMENTS

Preferred embodiments of the invention and the best made contemplated for carrying it out are described by means of the following examples.

EXAMPLE 1

0.3 $m^3$ solution is circulated by a pump in an open, rectangular vessel of 0.5 m in width and 2 m in height through a nozzle of 20 mm in diameter.

The solution contains 0.5 kmole/$m^3$ of sodium sulfite and 0.001 kmole/$m^3$ of cobalt sulfate. The temperature of the solution is maintained at 30° C. The free length of the liquid jet is 0.3 m.

Figure 1:
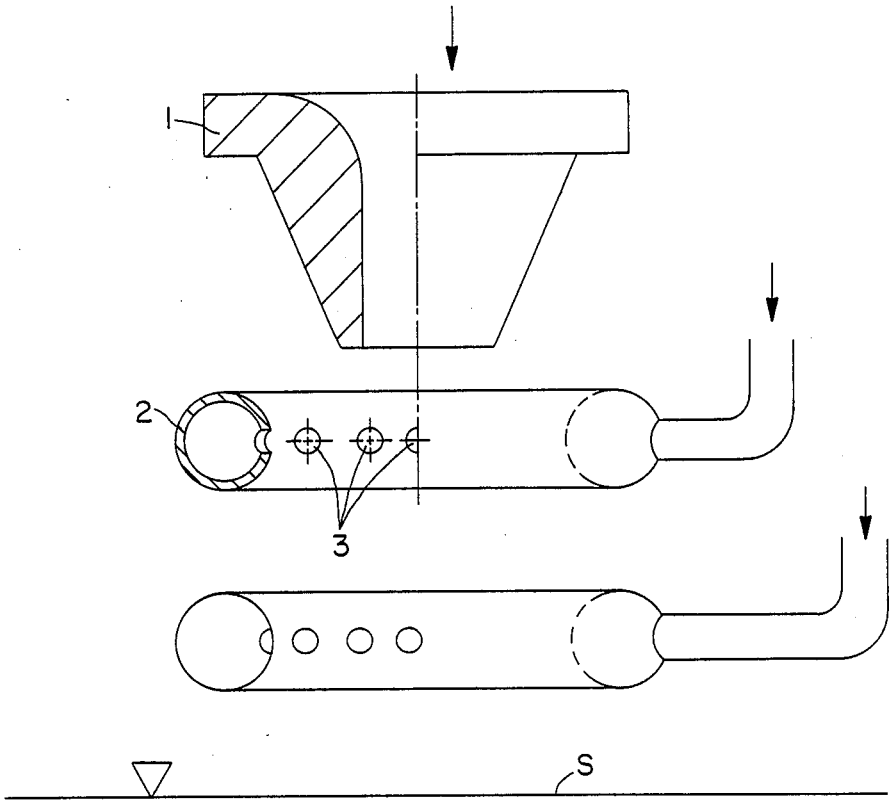
FIG. 1 is a schematic illustration of an embodiment of a nozzle.

The flow rate of the liquid circulated by the pump and blown onto the surfaces of the liquid is 20.4 $m^3$/h. A small part, i.e. 4% of the circulated liquid are led perpendicularly onto the surface of the liquid jet leaving the nozzle 1 (FIG. 1). The small part is directed through holes 3 being on a ring 2 made of a copper pipe of 10 mm in diameter which is located around the liquid jet. 12 Holes 3 of 1.2 mm diameter each are arranged on the ring at equal intervals. The distance between the holes and the surface of the liquid jet is 40 mm, the distance of the ring from the nozzle exit is 10 mm.

Based on the known method of measuring the oxidation of sodium sulfite (V. Linck and V. Vacek, Chem. Eng. Sci. 36, 1747 (1981), the volumetric oxygen transfer rate is found to be 27.2 kg of $O_2/m^3h$ which is equivalent to an oxygen input rate of 8.16 kg of $O_2$/h. The hydraulic power input of the pump is 0.91 kW, thus the energy efficiency of the oxygen input amounts to 8.97 kg of $O_2$/kWh.

COMPARATIVE CONTROL FOR EXAMPLE 1

The process described in Example 1 is repeated, except that no liquid is led onto the liquid jet. In this case, the volumetric oxygen transfer rate amounts to 16.8 kg of $O_2/m^3h$, the oxygen input rate is 5.04 kg of $O_2$/h and the energy efficiency of the oxygen input is 5.54 kg of $O_2$/kWh.

Based on this comparison, an improvement of 61.9% could be achieved both in the volumetric oxygen transfer rate, i.e. in the intensity of the gas-liquid contacting, as well as in the energy efficiency by using the process of the invention.

EXAMPLE 2

The process of Example 1 is repeated with the following changes:

The flow-rate of the circulated liquid amounts to 18.9 $m^3$/h and the hydraulic power input of the pump is 0.74 kW.

In this case, instead of the liquid used in Example 1, air is led through a ring 4 prepared from a copper pipe of 10 mm in diameter disposed around the liquid jet issuing from a nozzle 6. On the ring, 6 holes 5 of 1.5 mm in diameter each are arranged at equal intervals. As related to the horizontal direction, the holes are directed downward in an angle of 15°. The distance between the holes and the liquid jet is 21 mm, the distance between the ring and the nozzle exit amounts to 50 mm. The flow-rate of the air let through the holes is 4.5 $Nm^3$/h which is equivalent to a surplus power input of 0.1 kW over the hydraulic power input of the pump.

Based on the measuring method described in Example 1, a volumetric oxygen transfer rate of 21.7 kg of $O_2/m^3h$, an oxygen input rate of 6.52 kg of $O_2$/h and an energy efficiency of 7.82 kg of $O_2$/kWh are achieved.

COMPARATIVE CONTROL FOR EXAMPLE 2

The process described in Example 2 is repeated but without blowing of air. In this way 12.03 kg of $O_2/m^3h$, 3.61 kg of $O_2$/h and 4.92 kg of $O_2$/kWh values are measured.

Based on this comparison, an improvement of 80.7% was achieved in the intensity of the contacting, whilst the energy efficiency was improved by 58.9%.

EXAMPLE 3

0.1 $m^3$ of a solution with the composition described in Example 1 is circulated by a pump through a nozzle of 10 mm in diameter in a closed vessel of 0.45 m in diameter and 1.5 m in height. The flow-rate of the liquid circulated by the pump is 6.84 $m^3$/h, the hydraulic power input of the pump amounts to 0.56 kW.

Figure 2:
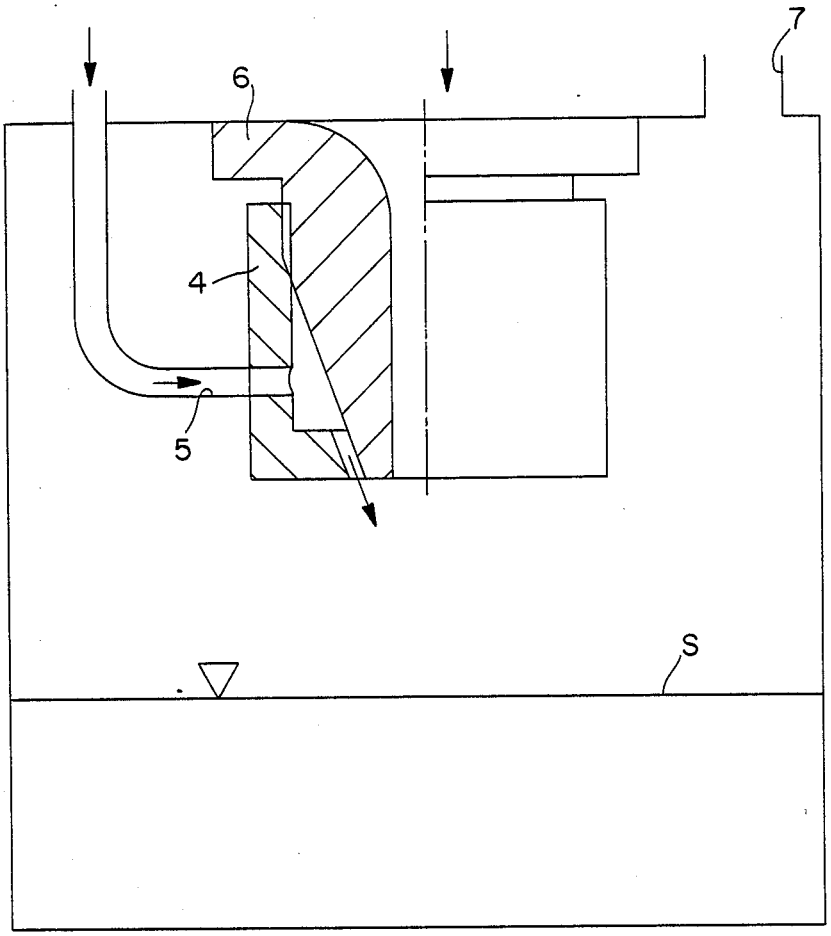
FIG. 2 is a schematic illustration of another embodiment.

Air is introduced into the vessel at a flow-rate of 16 $Nm^3$/h through a slot 3 of 0.5 mm in width shaped by a polyamide profile 4 threaded onto the body of the nozzle 6 which is also made of polyamide (FIG. 2). The distance of the slot from the surface of the liquid jet is 5 mm and an angle of 15° is included between the flowing-out air and the liquid jet. The introduction of air demands a power input of 0.18 kW. The air leaves the top of the vessel through an opening 7 of 20 mm in diameter set at a distance of 200 mm from the axis. The free length of the liquid jet is 0.4 m.

In this case, the volumetric oxygen transfer rate is found to be 41.2 kg of $O_2/m^3h$. Accordingly, the oxygen input rate amounts to 4.12 kg of $O_2/h$ and the energy efficiency of the oxygen input is 5.57 kg of $O_2/kWh$.

COMPARATIVE CONTROL FOR EXAMPLE 3

The process described in Example 3 is repeated with the difference that the air to be contacted is introduced vertically downward at the top of the vessel through an orifice of 20 mm in diameter set at a distance of 200 mm from the axis, whilst the used air leaves the vessel through an orifice of the same dimension set oppositely at the same distance. Thus, the same amount of air as above is introduced into the system without leading it directly onto the liquid jet. The volumetric oxygen transfer rate is 29.0 kg of $O_2/m^3h$ which is equivalent to an oxygen input rate of 2.9 kg of $O_2/h$ and an efficiency of oxygen input of 3.92 kg of $O_2/kWh$, respectively.

Based on this comparison, an improvement of 42.1% could be achieved both in the intensity of the oxygen transfer as well as in the efficiency thereof.

EXAMPLE 4

The process described in Example 1 is repeated, except that a ring for conducting the air is used below the liquid-conducting ring according to Example 2. Thus, the roughening of the liquid jet is simultaneously carried out by conducting liquid and air onto the surface of the jet.

The volumetric oxygen transfer rate is found to be 30.9 kg of $O_2/m^3h$ which is equivalent to an input of 9.27 l kg of $O_2/h$, i.e. to an energy efficiency of 9.18 kg of $O_2/kWh$.

COMPARATIVE CONTROL FOR EXAMPLE 4

The process described in Example 4 is repeated with the difference that neither air nor liquid are conducted, i.e. the comparative control for Example 1 is followed. Thus, an increase of 83.9% in the intensity and an increase of 65.7% in the energy efficiency were achieved with the aid of the process of the invention.

We claim:

1. A process for contacting a gas with a liquid, comprising ejecting through a nozzle the liquid to be contacted in the form of a jet, through a space containing the gas to be contacted, and through the surface of the liquid to be contacted, and blowing at least a part of the gas, or at least a part of the liquid to be contacted, or both, onto the surface of the ejected liquid as streams of gas, or of liquid, or of both, through a partially enclosed annular space having a slot or a plurality of orifices substantially surrounding and facing the jet.

2. The process of claim 1, wherein the opening of said orifices is disposed at an angle, other than a rectangle, with respect to the axis of said jet.

3. The process of claim 1, further comprising passing said jet through a second annular pipe, and blowing at least a part of the gas onto said jet through a plurality of orifices disposed in the interior of said second annular pipe.

4. The process of claim 1, wherein part of the gas is blown on the surface of the jet through an orifice in said nozzle.

* * * * *